US005157839A

United States Patent [19]

Beutler

[11] Patent Number: 5,157,839

[45] Date of Patent: Oct. 27, 1992

[54] ILLUMINATED REAR PEEP SIGHT FOR A BOW

[75] Inventor: Robert C. Beutler, Sand Creek, Mich.

[73] Assignee: Kenneth Anderson, Toledo, Ohio ; a part interest

[21] Appl. No.: 715,432

[22] Filed: Jun. 14, 1991

[51] Int. Cl.[5] ..... F41G 1/467; F41B 5/00

[52] U.S. Cl. ..... 33/265; 33/241

[58] Field of Search ..... 33/265, 241; 124/87

[56] References Cited

U.S. PATENT DOCUMENTS

| | | | |
|---|---|---|---|
| 2,171,571 | 9/1939 | Karnes | 33/241 |
| 3,410,644 | 11/1968 | McLendon | 356/247 |
| 4,625,422 | 12/1986 | Carlson | 124/87 |
| 4,977,677 | 12/1990 | Troescher | 33/265 |

*Primary Examiner*—Harry N. Haroian
*Attorney, Agent, or Firm*—William J. Clemens

[57] ABSTRACT

A rear peep sight apparatus for use with a bow includes a body formed of a transparent material for mounting in a bow string. The body has generally parallel front and rear surfaces connected by a curved side surface and the side surface and a portion of each of the front and rear surfaces is opaque. The body has a cavity formed therein for mounting a light source which is connected by a spiral wound elastic conductor to a battery and switch enclosed in a housing which can be releaseably attached to the bow. The peep sight can include sighting means such as, for example, an oval ring, a dot and a cross hair. In the alternative, the light source can be located in the housing and the light transmitted through a fiber optic conductor to the body.

15 Claims, 2 Drawing Sheets

ILLUMINATED REAR PEEP SIGHT FOR A BOW

BACKGROUND OF THE INVENTION

The present invention relates generally to an apparatus for archery bow sighting and, in particular, to a bow string mounted rear sight assembly.

An archer, operating a bow, mounts a nock of an arrow at a nocking point on a bow string of the bow prior to drawing the bow string. A shaft of the arrow is placed on a arrow rest position generally at a midpoint on one side of the bow. The archer then draws the bow string back generally using the fingers of one hand while holding the bow with the opposite hand. Traditionally, to establish proper arrow trajectory once the bow string is fully drawn, the archer typically placed the hand griping the bow string at a reference point on or near the archer's face and also aligned his eye directly behind a vertical plane passing through the side of the bow against which the arrow is rested and the drawn bow string for target sighting.

Such a target sighting process was prone to error. To improve the accuracy and precision of the sighting process, bows and bow strings were provided with various sighting devices to assist the archer in establishing proper arrow trajectory.

Such sighting devices have included sighting pins for installation on the bow and peep sights for installation in or on the bow string. Sighting pins are adjustably mounted on and extend horizontally from the bow at a preset position above the arrow rest and are used in conjunction with a peep sight mounted in spaced relation above the nocking point so as to be in the line of sight of the archer. Thus, use of peep sights and sighting pins improve the archer's ability to establish proper arrow alignment and trajectory.

In low light conditions, however, target sights are difficult or impossible to use. One solution, associated with fire arms, has been to provide an illuminated sight. U.S. Pat. Nos. 2,987,821, 3,678,590 and 3,914,873 disclose lighted sights for guns.

Lighted front sights and sighting pins have been used with bows. For example the following U.S. Pat. Nos. show lighted front sights for bows: 4,117,572; 4,215,484; 4,638,565; 4,689,887; 4,928,394; 4,953,302; and 4,977,677.

The traditional peep sights also have been difficult to use in low light conditions. Such peep sights are shown in the U.S. Pat. Nos. 3,703,770, 3,703,771, 3,859,733 and 4,011,853.

SUMMARY OF THE INVENTION

The present invention concerns a peep sight assembly for use with an archery bow including a rear peep sight having a generally oval body formed of transparent material for mounting in a bowstring, the body having generally parallel front and rear surfaces connected by a curved side surface, the side surface and a portion of each of the front and rear surfaces being opaque, and the body having a cavity formed therein. A light source is mounted in the cavity and is connected to a source of electrical power for illuminating at least a central portion of said body. An electrical conductor connected between the light source and the source of electrical power is spiral wound and elastic for extending as the bow is drawn and retracting when the bow is released.

A sighting means is formed on at least one of the front and rear surfaces. The sighting means can be of any suitable form such as an oval ring, a dot, or a cross hair.

The source of electrical power includes a housing enclosing a battery electrically connected to the light source and attachment means, such as a hook and loop fastener, for releasably attaching the housing to the bow. An on/off switch is attached to the housing and connected in series with the light source and the battery. The light source can be any suitable device such as an incandescent lamp or a light emitting diode. In an alternate embodiment, the light source, the switch and the battery all can be mounted in a cavity formed in the peep sight body.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
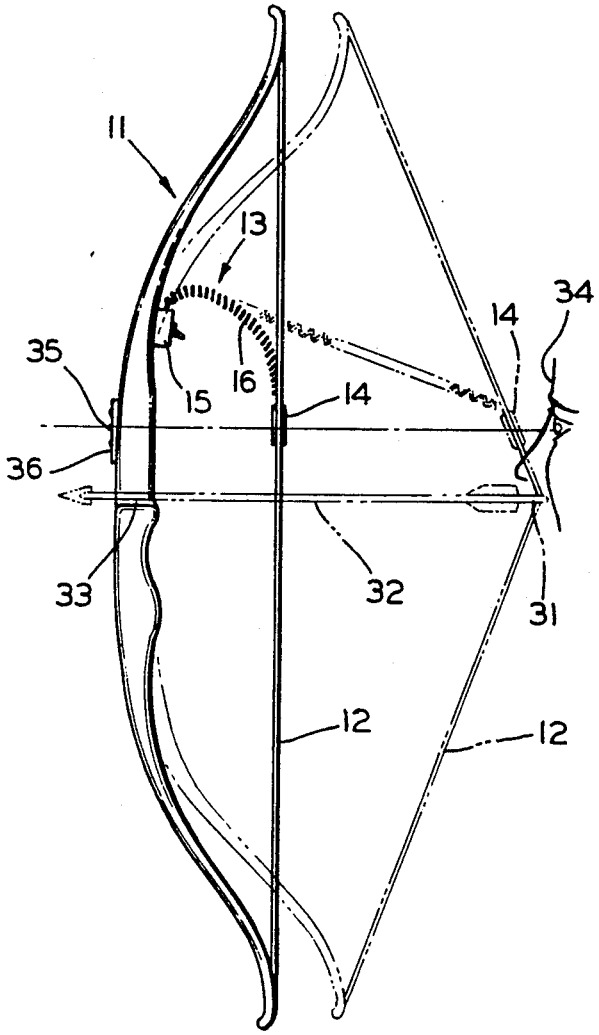
FIG. 1 is a side elevation view of an undrawn bow having a rear peep sight assembly in accordance with the present invention mounted on the bowstring.

There is shown in the FIG. 1 a bow 11 strung with a bow string 12 and having a peep sight assembly 13 mounted thereon. The assembly 13 includes a rear peep sight 14 mounted in the bow string 12, a power supply and switch assembly 15 attached to a rearwardly facing surface of the bow 11 and an electrical conductor 16 connected between the peep sight 14 and the power supply 15.

Figure 2:
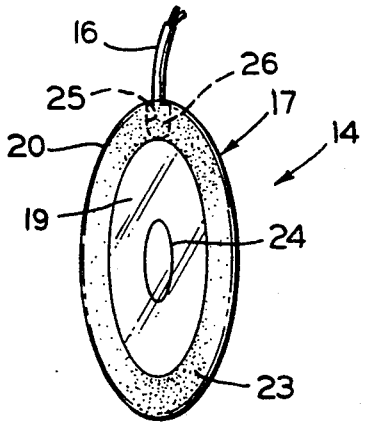
FIG. 2 is an enlarged rear elevation view of the peep sight apparatus shown in the FIG. 1.
Figure 3:
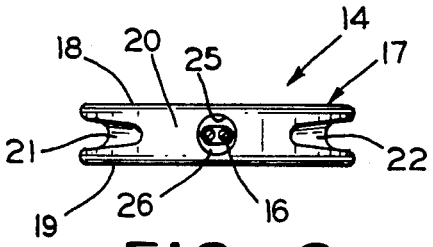
FIG. 3 is a top plan view of the peep sight apparatus shown in the FIG. 2.
Figure 4:
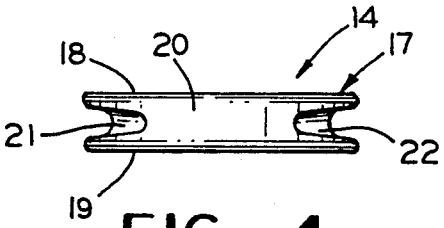
FIG. 4 is a bottom plan view of the peep sight apparatus shown in the FIG. 2.

As shown in the FIGS. 2 through 4, the rear peep 14 has a generally oval-shaped solid body 17 including generally parallel planer front surface 18 and rear surface 19. The surfaces 18 and 19 are connected by a curved side surface 20 extending completely around the body 17 and having a pair of opposed concave slots 21 and 22 formed therein. The bow string 12 is typically formed of a plurality of strands which can be separated into two generally equal size groups which are retained in the slots 21 and 22 when the body 17 is mounted in the bow string 12.

The body 17 of the rear peep sight 14 is typically formed of a transparent material. The side surface 20 and the peripheral portions of the front surface 18 and the rear surface 19 can be rendered opaque by any suitable means such as a non-glare coating 23. As shown in the FIG. 2, the coating 23 leaves a central portion of the rear surface 19 transparent. The coating 23 is formed in a similar manner on the front surface 18 such that an archer can look through the rear peep sight 14 when sighting the bow 11. As a sighting aid, an oval-shaped ring 24 can be formed in the center of the rear surface 19 or the front surface 18 or anywhere in between to function as a sighting means.

The body 17 also has a cavity 25 formed at an upper portion of the side surface 20. The cavity 25 receives a lamp 26. The lamp 26 is electrically connected to the conductor 16 which can be a two wire conductor as shown.

The rear peep sight 14 can be configured otherwise than as shown and still perform its intended function. For example, the ring 24 can represent the wall of an oval-shaped aperture formed in the center of the body 17 as a sighting means. The ring 24 also could be a wall of a tube inserted in an oval-shaped aperture formed in the body 17 as a sighting means. Of course, the body 17 does not have to be oval-shaped. The body 17 could be of a rectangular shape or any other desired shape for supporting the sighting means.

Figure 5:
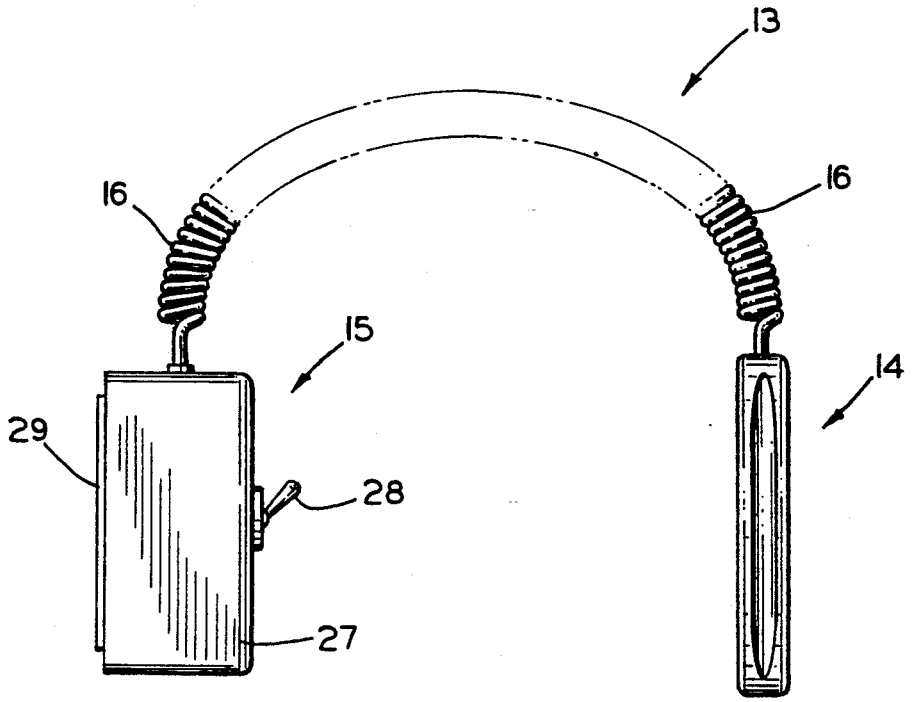
FIG. 5 is a side elevation view of the rear peep sight assembly shown in the FIG. 1.

There is shown in the FIG. 5 the peep sight assembly 13 consisting of the rear peep sight 14, the power supply 15 and the conductor 16. The power supply 15 can include a housing 27 enclosing a battery (not shown). Attached to the housing 27 is a switch 28 which is connected to the battery (not shown) and to the conductor 16 as described below. Also attached to the housing 27 and mounted on an external surface thereof is an attachment device 29. The attachment device can be, for example, a hook and loop type fastener for releasably attaching the housing 27 to the bow 11.

Figure 6:
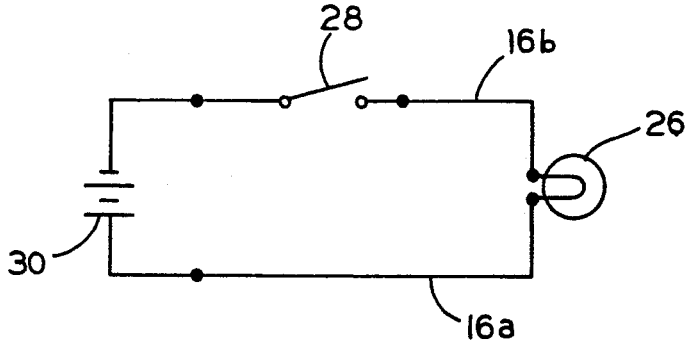
FIG. 6 is an electrical circuit schematic of the peep sight assembly shown in the FIG. 1.

An electrical circuit schematic of the peep sight assembly 14 is shown in the FIG. 6. A filament of the lamp 26 is connected to one end of each of the two wires of the conductor 16. A wire 16*a* is connected between one end of the filament of the lamp 26 and a positive terminal of a power supply such as a battery 30. The other wire 16*b* is connected between the other end of the filament of the lamp 26 and one terminal of the switch 28. The other terminal of the switch 28 is connected to a negative terminal of the battery 30. The switch 28 is a single pole on/off switch utilized to turn the lamp 26 on and off. When turned on, the lamp 26 provides light to the interior of the peep sight body 17. The coating 23 prevents the light from escaping through the side surface 20 and the peripheral portions of the front surface 18 and the rear surface 19. The coating 23 can be reflective on the interior surface. Thus, the light from the lamp 26 is concentrated in the center of the body to illuminate the oval ring 24 when external illumination is insufficient for the archer to accurately locate the ring 24.

As shown in the FIGS. 1 and 5, the conductor 16 is coiled much like the cord between the hand set and the base of a conventional telephone. The length of the conductor 16 is selected such that when the bow is at rest, as shown in the FIG. 1, the conductor is tightly coiled but extends in a relatively straight line between the rear peep sight 14 and the power supply 15. When the bow string 12 is fully drawn as shown in phantom, the nock 31 of an arrow 32 engages the string 12. The shaft of the arrow 32 extends forward and rests against an arrow rest 33 on the bow 11. An archer 34 can sight through the rear peep sight 14 in order to align a target (not shown) with an appropriate pin 35 of a front sight 36 mounted on a front surface of the bow 11.

As an alternative, the lamp 26 could be located in the housing 27 and the conductor 16 could be a fiber optic conductor. In that case, the end of the conductor 16 in the housing 27 would be located adjacent to the lamp 26 and light would be transmitted through the conductor 16 to the end attached to the rear peep sight 14.

Figure 7:
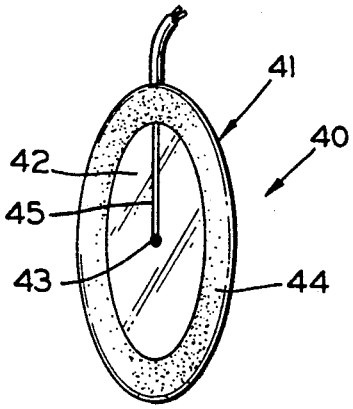
FIG. 7 is a rear elevation view of an alternate embodiment of the rear peep sight apparatus shown in the FIG. 2.

Although the rear peep sight 14 has ben shown with an oval ring 24 located at its center, any other suitable sighting aid can be utilized. For example, as shown in the FIG. 7, a rear peep sight 40, similar to the rear peep sight 14, has a generally transparent body 41 with a rear surface 42. Located at the center of the rear surface 42 is a dot 43 which can be utilized by the archer 34 shown in the FIG. 1 as a sighting means to align with the pin 35. In the alternative, that portion of the body 41 interior of a periphery which has a coating 44 applied thereto can be formed as an aperture. The dot 43 can be supported by a support column 45 connected between the dot 43 and a wall of the aperture in the body 17. The column 45 can transmit light from the light source to illuminate the dot 43.

Figure 8:
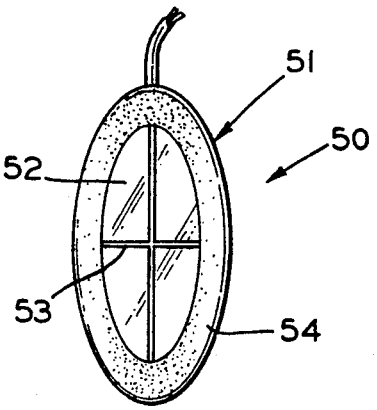
FIG. 8 is a rear elevation view of a second alternate embodiment of the rear peep sight apparatus shown in the FIG. 2.

A second alternate embodiment of the present invention is shown in the FIG. 8 as a rear peep sight 50. The peep sight 50 has a generally transparent body 51 with a rear surface 52 having a cross hair 53 formed thereon. The cross hair 53 can be utilized by the archer 34 shown in the FIG. 1 as a sighting means to align the pin 35 with the target. Alternatively, that portion of the body 51 interiorly of a periphery which has a coating 54 applied thereto can be formed as an aperture. In that case, the cross hair 53 can be formed as light transmitting walls or columns supported by connection to the wall of the aperture formed in the body 17.

Figure 9:
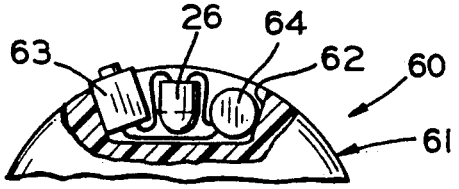
FIG. 9 is a fragmentary rear elevation view of an alternate embodiment of the rear peep sight assembly shown in the FIG. 5 with a third alternate embodiment of the peep sight apparatus.

There is shown in the FIG. 9 an alternate embodiment of the rear peep sight assembly in accordance with the present invention. This assembly is self contained with all of the elements being mounted on the bow string. A rear peep sight 60 has a body 61 which is similar to the peep sight body 17 shown in the FIG. 2. However, a larger cavity 62 has been provided in place of the cavity 25. Mounted in the cavity 62 with the lamp 26 is a switch 63 and a battery 64. The switch 63 is a push button switch which operates in a manner similar to the switch 28. The battery 64 is a miniature battery which supplies electrical power in a manner similar to the battery 30. The lamp 26, the switch 63 and the battery 64 are connected in series in accordance with the schematic diagram of the FIG. 6.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A rear peep sight apparatus for use with an archery bow comprising:

a body supporting a sighting means and means formed in said body for mounting said body on a bowstring, said body having generally parallel front and rear surfaces connected to a side surface, said side surface and a peripheral portion of each of said front surface and said rear surface being opaque, said sighting means being positioned in a transparent central portion of said body;

a light source attached to said body for supplying light to an interior of said body to illuminate said sighting means; and a source of electrical power connected to said light source by an electrical conductor, said electrical conductor being spiral wound for extending as the bow is drawn and retracting when the bow is released.

2. The apparatus according to claim 1 wherein said means for mounting includes said body having a pair of opposed concave slots formed therein for receiving strands of a bowstring.

3. The apparatus according to claim 1 wherein said body has a cavity formed therein for receiving said light source.

4. The apparatus according to claim 1 including an on/off switch connected in series with said light source and said source of electrical power.

5. The apparatus according to claim 1 wherein said source of electrical power includes a housing enclosing a battery electrically connected to said light source.

6. The apparatus according to claim 5 including attachment means for releasably attaching said housing to the bow.

7. The apparatus according to claim 6 wherein said attachment means is a hook and loop fastener.

8. The apparatus according to claim 1 including a fiber optic conductor connected between said light source and said body.

9. The apparatus according to claim 1 wherein said body has an aperture formed therein and said sighting means is supported by connection to a wall of said aperture.

10. The apparatus according to claim 1 wherein said sighting means is formed in the shape of an oval ring.

11. The apparatus according to claim 1 wherein said sighting means is formed in the shape of a dot.

12. The apparatus according to claim 1 wherein said sighting means is formed in the shape of a cross hair.

13. A peep sight apparatus for use with an archery bow comprising:

a rear peep sight having a body formed of transparent material and including means for mounting on a bowstring, said body having generally parallel front and rear surfaces connected by a curved side surface;

an electrically powered light source attached to said body for supplying light;

a source of electrical power attached to said body and connected to said light source; and sighting means supported on said body and illuminated by said light from said light source.

14. The apparatus according to claim 13 wherein said side surface and a portion of each of said front surface and said rear surface is opaque and reflects said light toward said sighting means.

15. A peep sight apparatus for use with an archery bow comprising:

a rear peep sight having a body formed of transparent material and including means for mounting on a bowstring, said body having generally parallel front and rear surfaces connected by a curved side surface, said side surface and a portion of each of said front and said rear surfaces being opaque;

an electrically powered light source for supplying light attached to said body;

a source of electrical power connected to said light source; and a sighting means supported by said body and illuminated by said light source.

* * * * *